United States Patent [19]

Graham

[11] Patent Number: 5,062,482

[45] Date of Patent: Nov. 5, 1991

[54] PIEZOMETER ACTUATOR DEVICE AND METHOD FOR ITS INSTALLATION IN A BOREHOLE

[75] Inventor: John P. Graham, Edmonton, Canada

[73] Assignee: Alberta Oil Sands Technology and Research Authority, Edmonton, Canada

[21] Appl. No.: 390,011

[22] Filed: Aug. 7, 1989

[51] Int. Cl.[5] ..... E21B 47/00

[52] U.S. Cl. ..... 166/250; 166/65.1; 166/100; 73/151

[58] Field of Search ..... 73/151, 155, 727, 754, 73/DIG. 4, 152, 866.5; 166/65.1, 101, 116, 118, 136, 179, 211, 250, 253, 100, 254, 214, 285, 382; 340/853, 870.3; 364/179; 175/40, 50

[56] References Cited

U.S. PATENT DOCUMENTS

| | | | |
|---|---|---|---|
| 2,262,655 | 11/1941 | Seale | 166/100 |
| 3,677,081 | 7/1972 | Newton et al. | 73/155 |
| 3,798,966 | 3/1974 | Planche | 73/151 |
| 3,895,527 | 7/1975 | McArthur | 73/151 |
| 4,665,398 | 5/1987 | Lynch et al. | 340/853 |
| 4,715,440 | 12/1987 | Boxell et al. | 166/100 |
| 4,775,009 | 10/1988 | Wittrisch et al. | 166/250 |

*Primary Examiner*—Terry L. Melius

*Attorney, Agent, or Firm*—Millen, White & Zelano

[57] ABSTRACT

A device is provided for installing multiple piezometers in a borehole at predetermined elevations. An inner support pipe which may be interconnected with a string of grouting pipe is utilized. A continuous fluid passageway for introduction of grout to the bottom of the borehole results by inclusion of the support pipe as an integral part of the string. A tray member is provided which carries a piezometer embedded in a layer of permeable material. The latter makes a hydraulic connection with the borehole wall. A spring assembly is adapted to move the tray outwardly and radially so as to bring the layer into contact with the borehole wall. A wire restrains the tray against the support pipe so as to permit the device to be inserted into the borehole. A messenger is inserted into the fluid passageway to sever the wires whereupon the spring expands, bringing the layer of permeable material into hydraulic connection with the borehole wall.

2 Claims, 6 Drawing Sheets

PIEZOMETER ACTUATOR DEVICE AND METHOD FOR ITS INSTALLATION IN A BOREHOLE

FIELD OF THE INVENTION

The present invention relates to a device for installing an instrument in a borehole at a predetermined elevation and to a novel method therefor.

BACKGROUND OF THE INVENTION

The invention was developed in connection with an underground test facility for recovering bitumen from subterranean oil sands. Whilst the invention will be described in connection therewith, it is not limited in application to that environment.

The oil sands involved are located in Northern Alberta and are buried under an overburden of varying thickness.

In those areas where the oil sand is close to the ground surface, the overburden is stripped off and the oil sand is mined with draglines. The oil sand is then conveyed to an extraction plant in which the bitumen is separated from the solids, using a process referred to in the industry as the hot water process.

However, most of the oil sand is buried too deeply to be processed in the manner just described. In this latter circumstance, the procedure used has involved drilling wells from the surface and introducing heat to the formation, through the wells, to reduce the viscosity of the bitumen and render it mobile. The heated bitumen is then produced through the same or other wells and brought to the surface.

There are many problems associated with the recovery of bitumen using thermal processes operated through wells extending from ground surface. These problems have been so severe that this technique is limited to commercial application in only the deepest, thickest and richest sections of the Alberta oil sands.

The present assignee, a research agency of the Alberta government, initiated a novel approach toward recovering bitumen from the buried oil sands. As a first step, two laterally spaced apart, vertical, large diameter shafts were drilled and cased from ground surface into the limestone formation underlying the oil sand. Horizontal tunnels or drifts were then extended from the shafts through the limestone using conventional blast-and-remove mining technique. The drifts connected the two vertical shafts, so that ventilation was secured. Steam injection and bitumen production wells were then drilled upwardly from the drifts and completed in the oil sand.

The recovery process applied involved emplacing a fluid production well which extended horizontally through the oil sand for 60 meters, generally parallel and close to the oil sand/limestone interface. A generally co-extensive steam injection well was run essentially parallel to and about 3 to 7 meters above the production well.

An extensive programme of geotechnical instrumentation was also undertaken. The programme was designed to measure the temperature, pore pressure displacement and (by inference) the effective stress fields within the steaming zone and in the formation adjacent to the tunnels.

Heating of a formation causes volume changes in both the mineral particles and the bulk matrix of the solids and in the pore fluids. These volume changes lead to deformations, changes in the formation stresses and to increases in the pore fluid pressures. Instruments known as piezometers (or pore pressure transducers) are utilized to measure pore pressure.

In conventional geotechnical engineering practice, piezometers are installed as follows. The instrument is first lowered on its cable to the desired depth in the borehole. A sand pack is then positioned around the piezometer so as to provide an efficient hydraulic connection between the latter and the formation. The sand pack is isolated, or sealed, above and beneath by means of bentonite pellets, grout or the like. This above-described method is quite practical when only a single piezometer needs to be installed and when the boreholes are shallow.

However, there are problems that arise when the boreholes are greater in depth than about fifty feet. Additionally, it becomes difficult when one seeks to install multiple piezometers to determine pore pressures at differing elevations in a single borehole. Exemplary difficulties involve space limitations or the inaccuracy of placement of the instruments at the predetermined depth because of the cable having become twisted or ensnarled. Furthermore, installing a multiplicity of piezometers at various depths is time-consuming and laborious because it is necessary to permit the seals above and beneath each sand pack plus piezometer to set prior to the insertion of each successive instrument. Disadvantageously, this prior art system lacks flexibility if, for example, it is found that after grouting an instrument is dysfunctional and it is not possible to remove it from the borehole for replacement.

There exists, therefore, the need for a method for installing a multiplicity of instruments in a single borehole and for a device therefor, characterized by the following advantages:

rapidity and ease of installation;
accuracy in depth placement; and
mechanical simplicity and ruggedness.

SUMMARY OF THE INVENTION

In accordance with a first aspect of the present invention, there is provided a device for installing multiple piezometers in a single borehole.

More specifically, the device incorporates the features of:

Providing an inner support pipe which may be interconnected with a string of grouting pipe, so as to form a string having a continuous fluid passageway for introduction of grout to the bottom of the borehole, said string including the support pipe as an integral part thereof;

Providing at least one tray member which is pivotally associated with the support pipe. The tray is provided with spring means which normally seek to expand to pivot the tray so that it will move radially outwardly from the support pipe into a second deployed position wherein its contents pressingly engage the borehole wall. The tray is further provided with means for restraining it against the support pipe, with the spring means compressed, in a first stowed position, so that the unit is sufficiently compact for entry into the borehole. The restraining means are adapted to be released from the surface;

The tray supports a piezometer, which piezometer is embedded in a pre-formed sand pack carried by the tray. The sand pack provides a hydraulic connection for the piezometer with the borehole wall. A large contact area with the borehole wall is provided by the sand pack, to ensure adequate communication with the formation. Preferably, the sand pack comprises sand and an epoxy compound in admixture, which mixture has been allowed to set;

Preferably, a second tray is associated with each support pipe in tandem with the first tray. The second tray is movable outwardly to contact the borehole wall, in the same manner as the first tray. The second tray functions as a guide for the cables of piezometers positioned deeper in the borehole. Thus, the cables are less likely to become entangled. Preferably, the second tray is provided with serrations along its outer edges which, when the trays are deployed, grip the borehole wall so as to prevent the device from becoming dislodged during the grouting operation.

In a method aspect, the invention is characterized by the following:

inserting a plurality of piezometers, each embedded in a sand bed and carried by a tray, into the borehole, said tray being in a stowed position on a string of grouting pipe, said tray having means, which may be actuated from the surface, for moving the tray outwardly and radially from the pipe to cause the sand pack to contact the borehole;

optionally, testing all the piezometers prior to deploying the trays;

actuating the trays so as to bring the sand pack into hydraulic connection with the formation; and then grouting the borehole in a single operation so as to hydraulically isolate the piezometers at differing elevations from one another.

The advantages arising from the practice of the invention include the following. First, it is possible to install a plurality of piezometers within a single borehole and test them in place. Then, defective instruments may be replaced downhole, prior to the grouting operation. The instruments may be accurately positioned at the desired elevation in the borehole. And, carrying out the grouting in a single step is much less time-consuming than the sequential process described earlier herein.

Broadly stated, the invention is a device for installing a piezometer at a predetermined elevation within a borehole, said device being interconnectable with a string of grout pipe, which comprises: a tubular support pipe, said support pipe being operative to combine with the grout pipe string to form an inner fluid passageway; a tray, carried by said support pipe, said tray carrying a piezometer embedded in a layer of permeable material, said layer being outermost and operative to make a hydraulic connection between the piezometer and borehole wall; spring means, associated with the tray, adapted to normally expand to move the tray outwardly and radially to bring the layer of permeable material into contact with the borehole wall; means for restraining said tray against the support pipe so as to permit the device to be inserted into the borehole; and means, operable from the ground surface, for releasing the restraining means whereby the spring means may expand to bring the layer of permeable material into hydraulic connection with the borehole wall.

DESCRIPTION OF THE PREFERRED EMBODIMENT

Figure 1:
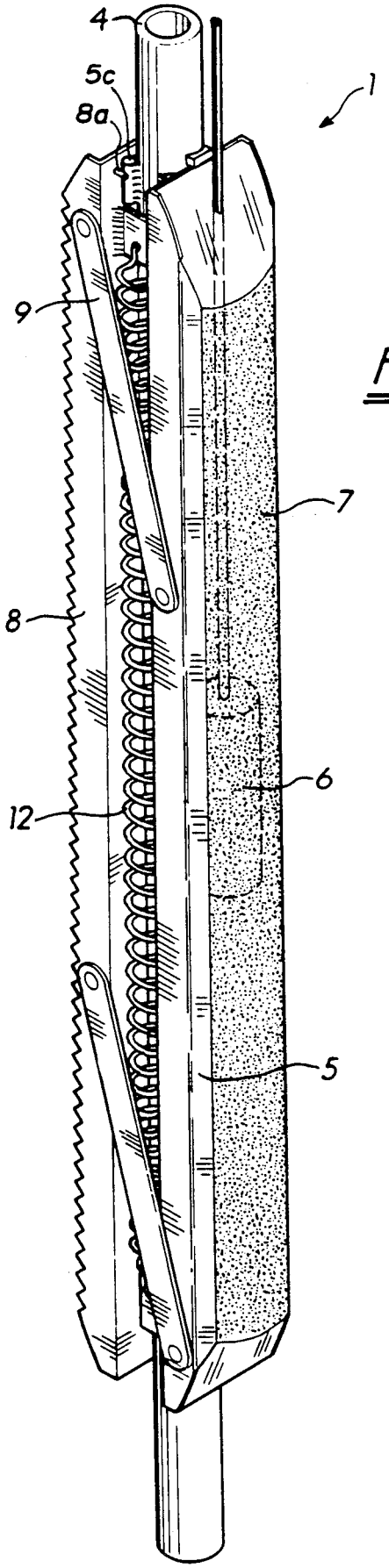
FIG. 1 is a perspective view of the piezometer actuator device in the stowed position.
Figure 2A:
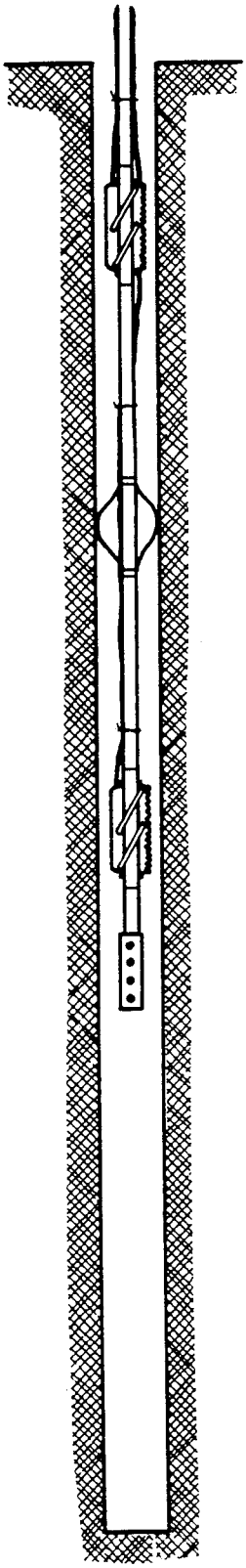
FIGS. 2*a*, 2*b* and 2*c* are a series of sectional views illustrating the method of installing a number of devices within the borehole.
Figure 2B:
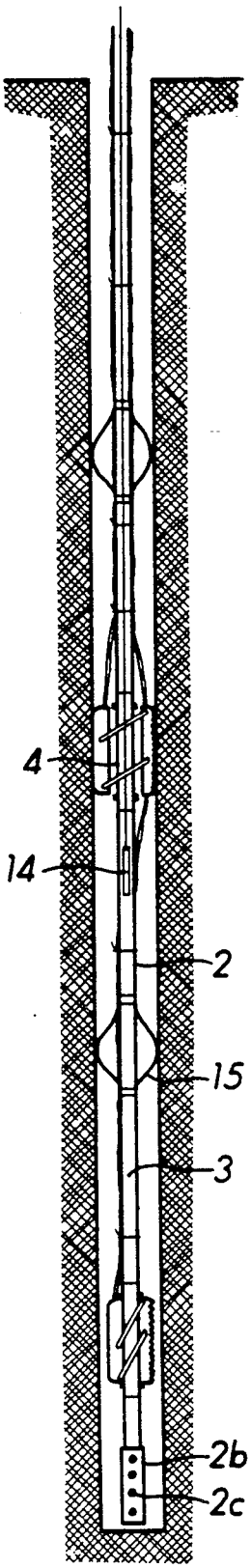
Figure 2C:
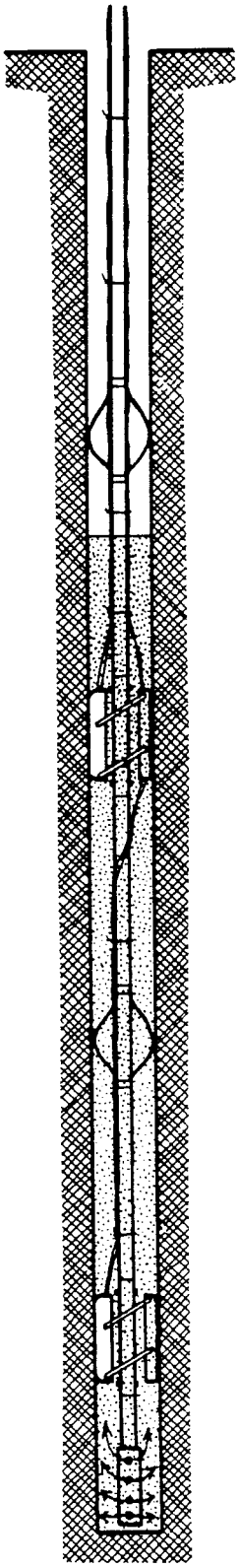
Figure 3:
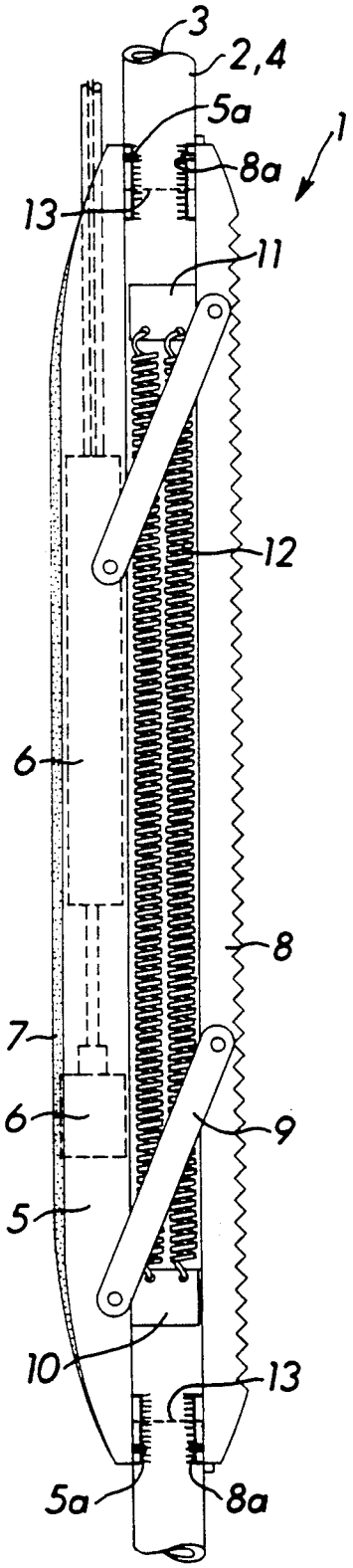
FIG. 3 is a sectional view of the device in the stowed position.
Figure 4:
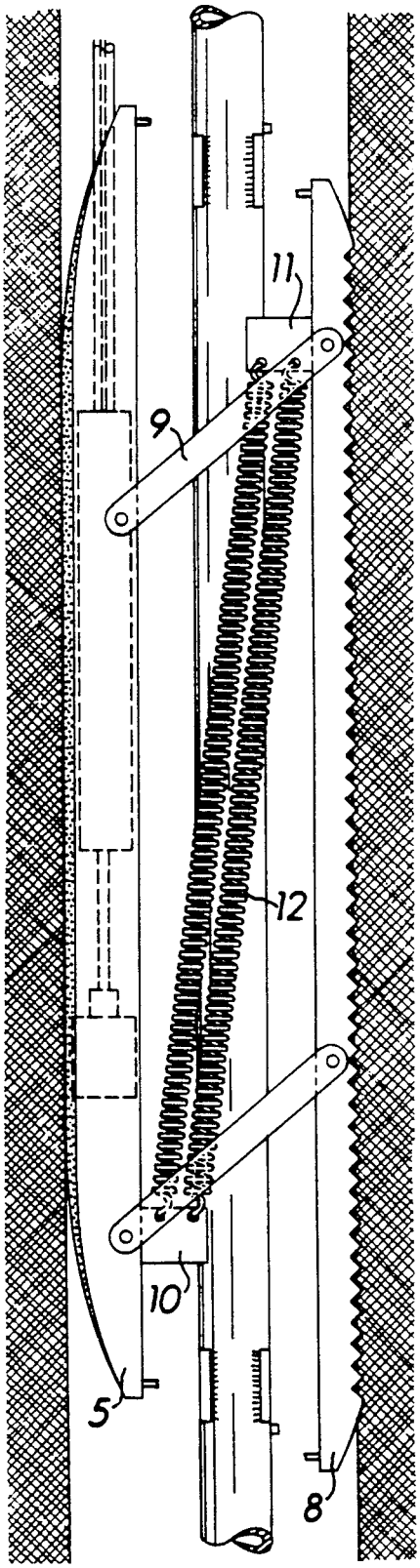
FIG. 4 is a sectional view of the device in the deployed position within the borehole.
Figure 5:
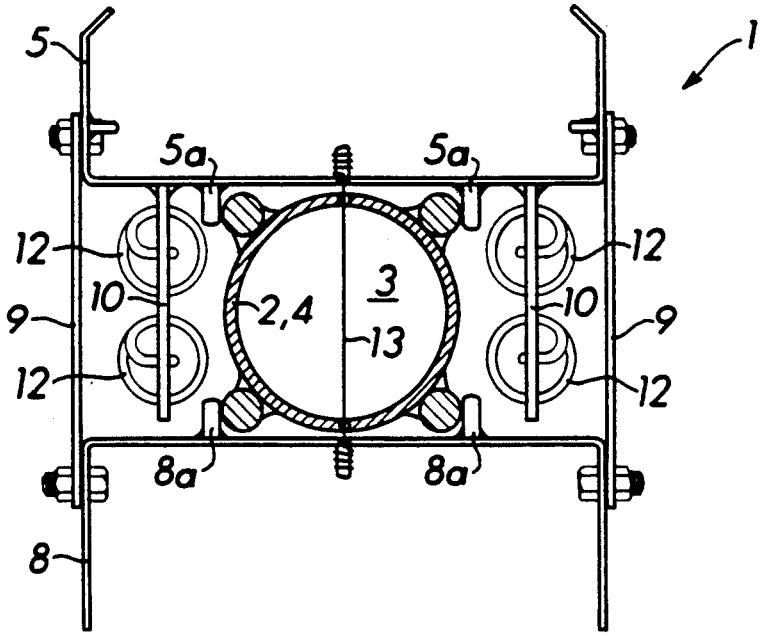
FIG. 5 is a cross-sectional view of the device of FIG. 1.
Figure 6A:
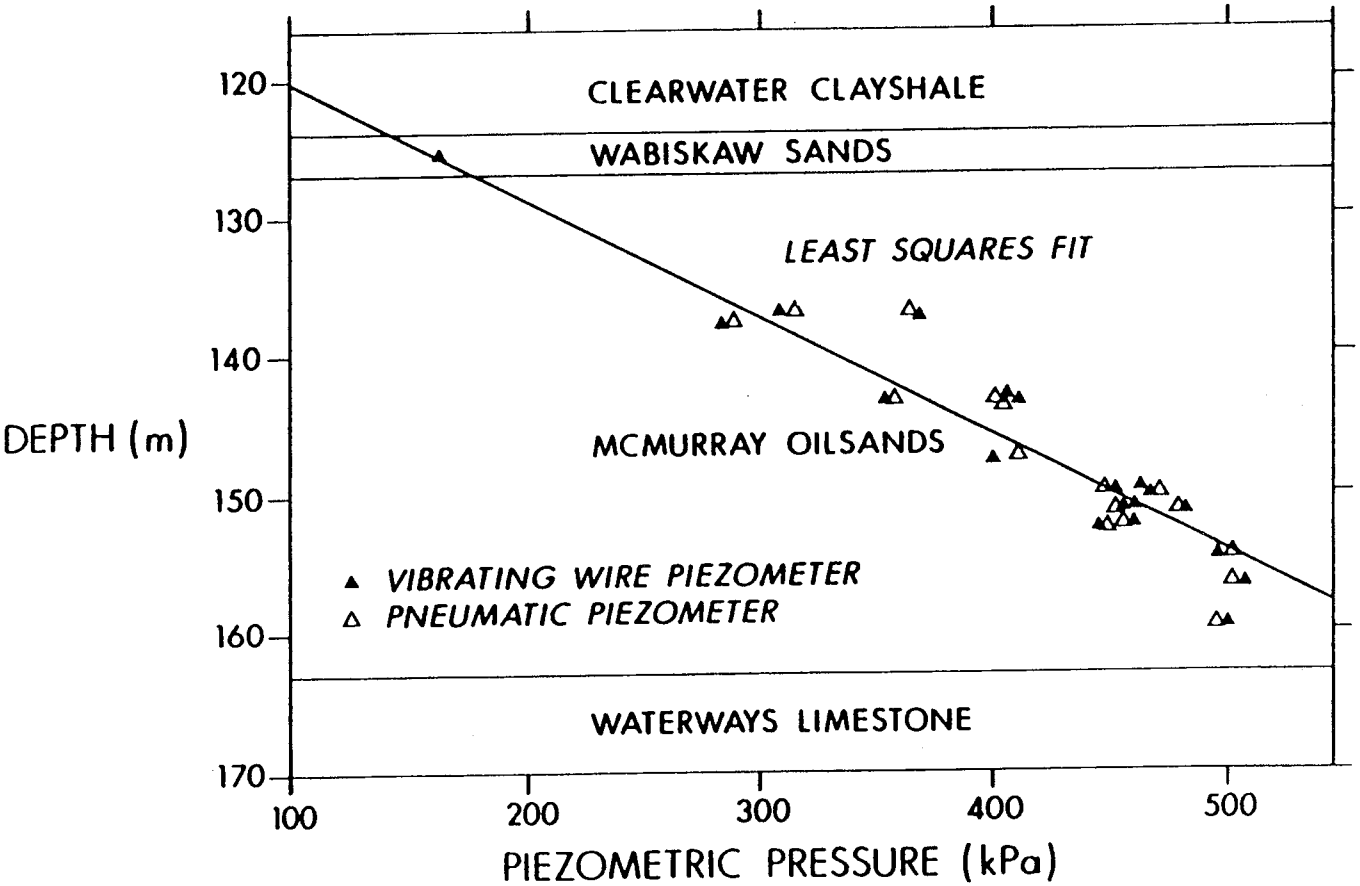
FIGS. 6*a* and 6*b* illustrate test results of surface well piezometer readings.
Figure 6B:
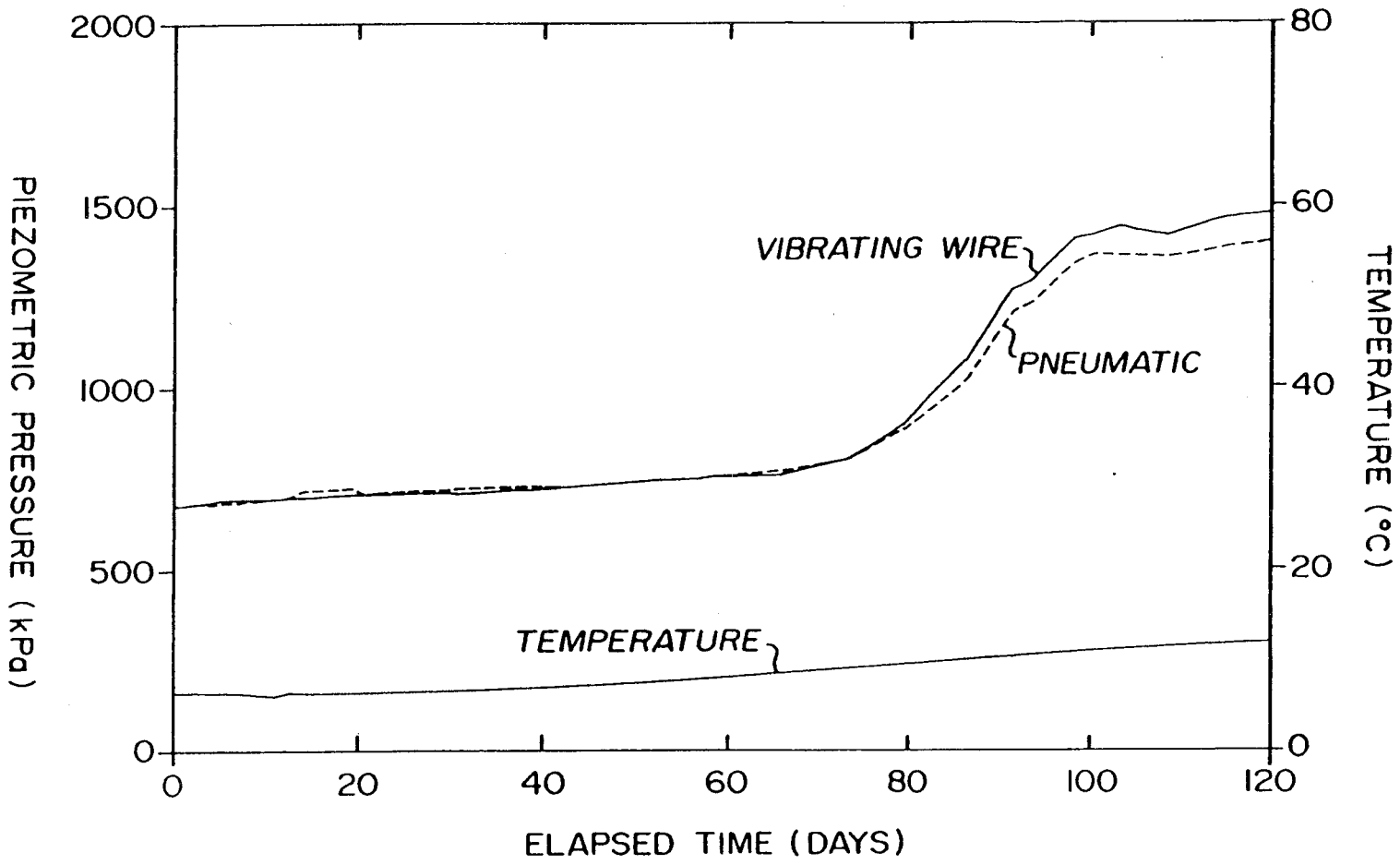

Having reference to the accompanying drawings, the piezometer actuator device 1 is adapted for use in a string 2 of conventional grout pipe which provides a continuous inner fluid passageway 3.

The device 1 includes a support pipe 4. The pipe 4 is threaded at each of its ends for engagement with the grout pipe 2.

A first, generally rectangular, elongate tray 5 is provided. The tray 5 carries a piezometer 6 which is embedded in a layer of permeable material 7. More specifically, the layer comprises a pre-formed sand pack 7 which is prepared by embedding the tip of the piezometer 6 in a porous epoxy/sand mixture. The mixture is shaped to the same curvature as the borehole wall and is allowed to set. At the outer ends of the tray 5, an epoxy coating is applied to prevent filtering of grout into the sand pack 7. It is desirable that a large contact area of the sand/epoxy medium be provided so as to ensure efficient hydraulic connection between the piezometer 6 and the surrounding formation.

A second tray 8 is pivotally connected to the tray 5 by means of links 9 to create a pivoting parallelogram which is mounted about the support pipe 4. The trays 5 and 8 carry inwardly projecting lugs 5*a*, 8*a* adjacent collars 5*c* secured to the support pipe 4.

Spring brackets 10 and 11 are affixed to opposite ends of the trays 5 and 8 respectively. A pair of coil springs 12 are secured to each of the spring brackets 10 and 11 and extend therebetween.

A wire 13 is attached to the ends of the trays 5, 8. The wire 13 passes transversely through the passageway 3 and through ports formed in the wall of pipe 4 to the bases of the trays 5, 8 to which it is secured. The wire 13, thus draws the trays 5 and 8 inwardly toward the pipe and locks them into the stowed position. The springs 12 are compressed.

The wires 13 can be severed by means of a messenger 14 which is lowered into passageway 3. When the wires 13 are severed, the springs 12 expand and the trays 5 and 8 are pivoted outwardly into the deployed position. Thus the piezometer 6 and pre-formed sand pack 7 are brought into hydraulic connection with the formation.

Lugs 5*a* and 8*a* are mounted on the undersides of the trays 5, 8, to prevent rotation of trays 5 and 8 thereon.

A multiplicity of piezometers may be installed in a single borehole at predetermined elevations as follows. A first length of grout pipe 2*b*, provided with perforations 2*c* at its base, is inserted in the borehole. The lower end of the support pipe 4 is threadedly engaged with the upper end of the grout pipe 2. A second length of grout pipe 2*c* having a centralizer 15 mounted thereon is connected to the upper end of the support pipe 4. In this manner the grout pipe with devices included therein are made up until the surface is reached.

The piezometers are then tested. If one is defective, the string can be pulled to replace it. Grout is then pumped down the fluid passageway 3 and out through the perforations 2*c*. Thus grouting takes place in a single operation for the entire assembly.

The embodiments of the invention in which an exclusive property or privilege is claimed are defined as follows:

1. A device for installing a piezometer at a predetermined elevation within a borehole, said device being interconnectable with a string of grout pipe, which comprises:

a tubular support pipe, said support pipe being operative to combine with the grout pipe string to form an inner fluid passageway;

a tray, carried by said support pipe, said tray carrying a piezometer embedded in a layer of permeable material, said layer being outermost and operative to make an hydraulic connection between the piezometer and borehole wall;

spring means, associated with the tray, adapted to normally expand to move the tray outwardly and radially to bring the layer of permeable material into contact with the borehole wall;

means for restraining said tray against the support pipe so as to permit the device to be inserted into the borehole; and means, operable from the ground surface, for releasing the restraining means whereby the spring means may expand to bring the layer of permeable material into hydraulic connection with the borehole wall.

2. A method for installing a piezometer at a predetermined elevation within a borehole which comprises:

inserting a plurality of piezometers, each embedded in a sand pack and carried by a tray, into the borehole, said tray being in a stowed position on a string of grouting pipe, said tray having means, which may be actuated from the surface, for moving the tray outwardly and radially from the pipe to cause the sand pack to contact the borehole;

optionally, testing all the piezometers prior to deploying the trays;

actuating the trays so as to bring the sand pack into hydraulic connection with the formation; and then grouting the borehole in a single operation so as to hydraulically isolate the piezometers at differing elevations from one another.

* * * * *